US009032596B2

(12) United States Patent
Tada et al.

(10) Patent No.: US 9,032,596 B2
(45) Date of Patent: May 19, 2015

(54) STEAM DRAWING APPARATUS

(75) Inventors: Akishige Tada, Hiroshima (JP); Isao Ooki, Hiroshima (JP); Yukihiro Mizutori, Hiroshima (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 14/240,092

(22) PCT Filed: Aug. 20, 2012

(86) PCT No.: PCT/JP2012/070984

§ 371 (c)(1),
(2), (4) Date: Feb. 21, 2014

(87) PCT Pub. No.: WO2013/027698

PCT Pub. Date: Feb. 28, 2013

(65) Prior Publication Data

US 2014/0201961 A1 Jul. 24, 2014

(30) Foreign Application Priority Data

Aug. 22, 2011 (JP) ..... 2011-180728
Aug. 22, 2011 (JP) ..... 2011-180731

(51) Int. Cl.
*D02J 1/22* (2006.01)
*D06B 23/16* (2006.01)
(Continued)

(52) U.S. Cl.
CPC ..... *D02J 1/222* (2013.01); *D06B 3/045* (2013.01); *D06B 23/18* (2013.01); *D02J 13/001* (2013.01); *D02J 13/006* (2013.01); *D06B 23/16* (2013.01)

(58) Field of Classification Search
CPC ..... D02J 13/001; D02J 13/003; D02J 13/005; D02J 13/006; D02J 1/222; D06B 23/16; D06B 23/18; D06B 3/045
USPC ..... 28/240, 241, 246, 219, 281, 271, 274; 68/5 D, 5 E, 5 C, 222; 19/66 R; 57/308; 264/289.6; 425/326.1
See application file for complete search history.

(56) References Cited

U.S. PATENT DOCUMENTS 2,142,909 A * 1/1939 Moncrieff et al. ..... 8/130
3,927,540 A * 12/1975 Tanaka et al. ..... 68/5 E
(Continued)

FOREIGN PATENT DOCUMENTS

JP 5-44132 2/1993
JP 7-70862 3/1995
(Continued)

*Primary Examiner* — Amy Vanatta
(74) *Attorney, Agent, or Firm* — Morgan, Lewis & Bockius LLP

(57) ABSTRACT

A steam drawing apparatus for providing pressurized steam on running yarn to draw the yarn, comprising a steam chamber; first seal chamber adjacent to a yarn entrance of the steam chamber; and second seal chamber adjacent to a yarn exit of the steam chamber, first seal chamber and second seal chamber are each provided with a labyrinth seal section having a plurality of plate pieces, first yarn-position regulating bar is provided to prevent the running yarn from touching the plate pieces, first yarn-position regulating bar extends horizontally intersecting the running direction of the yarn at right angles, and a horizontal plane passing through the point of the first yarn-position regulating bar closest to the yarn is set at least 0.1 mm closer to the yarn than a horizontal plane passing through the tip of the plate piece closest to the yarn.

17 Claims, 3 Drawing Sheets

(51) Int. Cl.

| | |
|---|---|
| ***D06B 3/04*** | (2006.01) |
| ***D06B 23/18*** | (2006.01) |
| ***D02J 13/00*** | (2006.01) |

(56) References Cited

U.S. PATENT DOCUMENTS

| | | | | |
|---|---|---|---|---|
| 4,059,668 | A * | 11/1977 | Bittle et al. | 264/289.6 |
| 7,356,984 | B2 * | 4/2008 | Brenk | 57/295 |
| 2006/0237914 | A1 * | 10/2006 | Li et al. | 277/415 |
| 2011/0283748 | A1 * | 11/2011 | Brenk et al. | 68/5 E |
| 2013/0340207 | A1 * | 12/2013 | Mizutori et al. | 19/66 R |
| 2014/0123713 | A1 * | 5/2014 | Mizutori et al. | 68/5 E |

FOREIGN PATENT DOCUMENTS

| | | |
|---|---|---|
| JP | 8-246284 | 9/1996 |
| JP | 2008-240203 | 10/2008 |
| JP | 2009-174073 | 8/2009 |
| JP | 2009-256820 | 11/2009 |
| WO | WO 2012/001995 A1 * | 1/2012 |

* cited by examiner

STEAM DRAWING APPARATUS

FIELD OF THE INVENTION

The present invention relates to a steam drawing apparatus for fiber yarn, more specifically, to a steam drawing apparatus capable of consistently drawing precursor fiber yarn for acrylic carbon fiber at a high stretch ratio.

DESCRIPTION OF BACKGROUND ART

Conventional drawing techniques using pressurized steam have been known in the fiber manufacturing industry. When pressurized steam is used, a higher temperature is obtained than when using hot water under atmospheric conditions, and the presence of water leads to a plasticizing effect on the cellulose polymer, thus resulting in drawing at a high stretch ratio.

On the other hand, when a pressurized steam drawing apparatus is used, pressurized steam may cause the fiber yarn to sway, and the yarn may touch structural members in the apparatus. Especially in the labyrinth seal section of the steam drawing apparatus, in order to improve the sealing effects of steam, it is preferred to employ a labyrinth seal structure having multiple plate pieces extending at right angles from the inner-wall surface of the seal chamber toward the yarn. However, when the yarn touches the labyrinth seal section, such contact may cause problems such as damaged yarn surface, broken single fibers, formation of fuzz, or entirely cut yarn. Such problems may cause further fuzz during flame-proofing and carbonization process and may lower the quality of a subsequently obtained carbon fiber.

As for preventing fuzz when drawing yarn using an apparatus with pressurized steam, methods such as follows have been proposed, for example: a method for squeezing yarn immediately before steam is applied to the yarn as described in Japanese Patent Laid-Open Publication H7-70862 (patent publication 1); a method for providing a steam box to preheat the introduced yarn as described in Japanese Patent Laid-Open Publication H8-246284 (patent publication 2); a method for removing the twist of the yarn by positioning a cylindrical guide immediately before the drawing apparatus and by bringing the yarn into contact with the guide as described in Japanese Patent Laid-Open Publication 2008-240203 (patent publication 3), Japanese Patent Laid-Open Publication 2009-174073 (patent publication 4) and the like.

PRIOR ART PUBLICATION

Patent Publication

Patent publication 1: Japanese Patent Laid-Open Publication H7-70862

Patent publication 2: Japanese Patent Laid-Open Publication H8-246284

Patent publication 3: Japanese Patent Laid-Open Publication 2008-240203

Patent publication 4: Japanese Patent Laid-Open Publication 2009-174073

SUMMARY OF THE INVENTION

Problems to be Solved by the Invention

However, even with the technologies disclosed in patent publications 1~4 above, it is impossible to completely prevent yarn from touching the labyrinth portion, and significant improvement has not been achieved in preventing lowered quality and lowered productivity caused by broken single fibers.

The objective of the present invention is to provide a steam drawing apparatus capable of significantly improving troublesome situations such as formation of fuzz and broken fibers by preventing yarn from touching the labyrinth seal section of the steam drawing apparatus when applying steam drawing to the yarn so that a high-quality carbon-fiber precursor fiber is produced.

Solutions To The Problems

According to the present invention, a steam drawing apparatus for providing pressurized steam on running yarn to draw the yarn is structured with a steam chamber into which pressurized steam is introduced, a first seal chamber adjacent to a yarn entrance of the steam chamber, and a second seal chamber adjacent to a yarn exit of the steam chamber. In such a steam drawing apparatus, the steam chamber has a steam introducing portion to introduce the steam, the first seal chamber and the second seal chamber are each provided with a labyrinth seal section having multiple plate pieces extending respectively from the upper and lower inner-wall surfaces toward the yarn, and a first yarn-position regulating bar is provided to prevent the running yarn from touching the plate pieces. The first yarn-position regulating bar extends horizontally intersecting the running direction of the yarn at right angles, and is located on the other side of the yarn from the steam introducing portion, while being positioned between the steam introducing portion and a plate piece of the second seal chamber located on the same upper or lower side of the yarn as the steam introducing section and positioned closest to the steam chamber. A horizontal plane passing through the point of the first yarn-position regulating bar closest to the yarn is set at least 0.1 mm closer to the yarn than a horizontal plane passing through the tip of the plate piece closest to the yarn among multiple plate pieces of the first seal chamber on the same upper or lower side of the yarn as the first yarn-position regulating bar.

According to a preferred embodiment of the present invention, the first yarn-position regulating bar is shaped as a rod or a plate, and the portion closer to the yarn is rounded toward the running yarn. In addition, the first yarn-position regulating bar is preferred to be set so that the distance between the point of the first yarn-position regulating bar closest to the yarn in the steam chamber and the plane at the yarn exit of the steam chamber is no greater than one-quarter of the length of the steam chamber in the yarn running direction. Moreover, the portion of the plate piece closer to the yarn is preferred to be rounded toward the running yarn.

The steam drawing apparatus is preferred to be further provided with a second yarn-position regulating bar so that the running yarn is prevented from touching the plate piece. The second yarn-position regulating bar is preferred to extend horizontally intersecting the running direction of the yarn at right angles, and to be located on the other side of the yarn from the steam introducing portion while being positioned between the steam introducing portion and a plate piece of the first seal chamber located on the same upper or lower side of the yarn as the first yarn-position regulating bar and positioned closest to the steam chamber. In addition, a horizontal plane passing through the point of the second yarn-position regulating bar closest to the yarn is preferred to be at least 0.1 mm closer to the yarn than a horizontal plane passing through the tip of the plate piece closest to the yarn among the multiple plate pieces of the first seal chamber located on the same upper or lower side of the yarn as the second yarn-position regulating bar.

It is preferred that the second yarn-position regulating bar be shaped as a rod or a plate, and that the portion closer to the yarn be rounded toward the running yarn. Further, the second yarn-position regulating bar is preferred to be set in the steam chamber in such a way that the distance between the point of the second yarn-position regulating bar closest to the yarn and the plane at the yarn entrance of the steam chamber is no greater than one-quarter of the length of the steam chamber in the yarn running direction. In addition, the portion of the plate piece closer to the yarn is preferred to be rounded toward the running yarn.

In addition, a third yarn-position regulating bar may further be provided in the steam drawing apparatus as follows: The third yarn-position regulating bar is positioned horizontally intersecting the running direction of the yarn at right angles and is located on the upper side and/or lower side of the yarn to be adjacent upstream in the yarn running direction to the plate piece closest to the yarn entrance of the apparatus among multiple plate pieces in the first seal chamber; the horizontal plane passing through the point of the third yarn-position regulating bar closest to the yarn is set at least 0.1 mm closer to the yarn than a horizontal plane passing through the point of the plate piece closest to the yarn among the multiple plate pieces of the first seal chamber located on the same upper or lower side of the yarn as the third yarn-position regulating bar; and the distance between the point of the third yarn-position regulating bar closest to the yarn and the point of the plate piece closest to the yarn and closest to the yarn entrance is set at 100 mm or less.

A fourth yarn-position regulating bar may also be provided as follows: The fourth yarn-position regulating bar is positioned horizontally intersecting the running direction of the yarn at right angles and is located on the upper side and/or lower side of the yarn to be adjacent downstream in the yarn running direction to a plate piece closest to the yarn exit of the apparatus among plate pieces in the second seal chamber; the horizontal plane passing through the point of the fourth yarn-position regulating bar closest to the yarn is set at least 0.1 mm closer to the yarn than a horizontal plane passing through the point of the plate piece closest to the yarn among the multiple plate pieces of the second seal chamber located on the same upper or lower side of the yarn as the fourth yarn-position regulating bar; and the distance between the point of the fourth yarn-position regulating bar closest to the yarn and the point of the plate piece closest to the yarn and closest to the yarn exit is set at 100 mm or less.

It is preferred that the portion closer to the yarn of the third yarn-position regulating bar and/or the fourth yarn-position regulating bar be shaped as a rod or a plate and rounded toward the running yarn. Also, the portion of the plate piece closer to the yarn is preferred to be rounded toward the running yarn. The yarn-position regulating bars may each be set as a non-rotating bar and the surface roughness (Ra) of each of the yarn-position regulating bars is preferred to be 0.4 a or less.

The steam chamber may be a tube-type steam chamber or a box-type steam chamber. The yarn-position regulating bars is each preferred to be made of ceramic-coated stainless steel or titanium, or hard chromium-plated iron or stainless steel.

Effects Of The Invention

A steam drawing apparatus according to the present invention is capable of securely preventing yarn from touching the labyrinth seal section of the pressurized steam drawing apparatus, thus problems such as broken single fibers, formation of fuzz and entirely cut yarn are prevented, and high-quality yarn is achieved and manufactured with consistency.

MODE TO CARRY OUT THE INVENTION

In the following, an embodiment of the present invention is described in detail with reference to the attached drawings.

Figure 1:
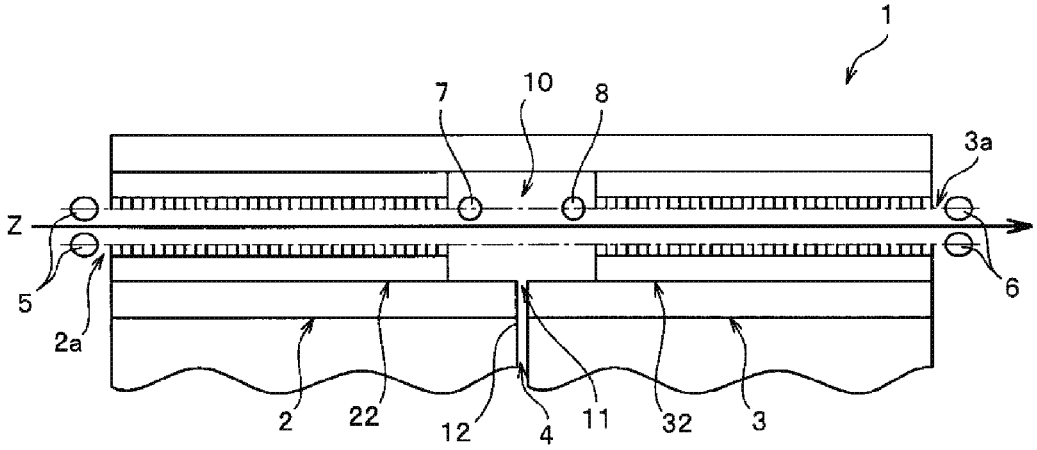
FIG. 1: a cross-sectional view schematically illustrating a steam drawing apparatus with a yarn-position regulating bar according to an embodiment of the present invention.

FIG. 1 is a cross-sectional view schematically showing the structure of steam drawing apparatus 1 for drawing running yarn under pressurized steam atmosphere according to the present invention. The scope of the application for pressurized steam drawing apparatus 1 of the present invention is not limited to any specific fiber type or processing, but it is especially effective when high-speed spinning is required. The drawing apparatus is especially suitable for obtaining thinner fineness, drawing at a high stretch ratio, high-speed processing or the like of carbon-fiber precursor fiber represented by acrylic fiber along with other synthetic fibers.

Before and after pressurized steam drawing, any well-known process for producing fiber may be conducted appropriately. For example, when solution spinning is employed for acrylic fiber, after an acrylonitrile-based copolymer containing an acrylonitrile homopolymer or comonomer as a raw-material polymer is dissolved in a well-known organic or inorganic solvent and the solution is spun, the yarn is drawn by employing the steam drawing of the present invention. In such a case, the spinning may be conducted by any of a wet, dry-wet or dry spinning method. Subsequently, removing the solvent, drawing in a bath, adhering an oil agent, drying or the like may be performed. Steam drawing may be conducted at any step during a fiber production process. However, if solution spinning is employed, steam drawing is preferred to be conducted after the solvent is removed to a certain degree from the yarn, namely, after a washing process or drawing the yarn in a bath, or after a drying process. It is more preferred to conduct steam drawing after a drying process from the viewpoint of obtaining fibers with high orientation.

In the present invention, yarn means a fiber bundle in which multiple single fibers are set in a bundle.

The steam pressure in the drawing atmosphere is not limited specifically as long as it is pressurized, namely, it is set higher than atmospheric pressure and is suitable for drawing purposes. That is, the steam pressure may be set appropriate to the type of fiber to be drawn, conditions of the steam drawing process, target properties of the fiber to be obtained and the like.

Pressurized steam drawing apparatus 1 according to the present invention is provided with steam chamber 10 into which pressurized steam is introduced, first seal chamber 2 positioned on the yarn entry side and second seal chamber 3 positioned on the yarn exit side, respectively arranged before and after steam chamber 10 in the yarn running direction.

Steam chamber 10 has steam introducing portion 4 for high-pressure and high-temperature steam. Steam introducing portion 4 of the present embodiment has steam inlet 11 formed in the center of the bottom portion of steam chamber 10 and steam pipe 12 connecting an external steam supply source not shown in the accompanied illustrations to steam inlet 11. As shown in the accompanied illustrations, steam introducing portion 4 is arranged in the center of the bottom portion of steam chamber 10, but it may also be arranged in the center of the ceiling portion, or both in the center of the bottom portion or the center of the ceiling portion, of steam chamber 10.

In first seal chamber 2 and second seal chamber 3, there are provided labyrinth seal sections (22, 32) with multiple plate pieces extending toward the yarn from the upper and lower inner-wall surfaces.

Along yarn running passages (13, 14) of first and second chambers (2, 3), multiple plate pieces (9, 21*a*, 21*b*; 31*a*, 31*b*) are formed from the upper and lower inner-wall surfaces (21, 31) of seal chambers (2, 3) to extend at right angles toward yarn (Z) running in one direction as shown in FIGS. 1~8. Those plate pieces form labyrinth seal sections (22, 32) form first and second chambers (2, 3) respectively. Of plate pieces (9, 21*a*, 21*b*; 31*a*, 31*b*), except for plate piece 9, the rest are set to be the same height. For example, as shown in FIGS. 2, 4, 6 and 8, plate pieces 9, each arranged at a portion closest to the yarn entrance or exit of labyrinth seal sections (22, 32), may be set higher than the other pieces. In addition, the tip of tall plate piece 9 is rounded toward the running yarn so as to avoid friction with yarn (Z) as much as possible. Here, instead of later-described first through fourth yarn-position regulating bars (8, 7, 5, 6), it is an option to use aforementioned tall plate piece 9 as a yarn-position regulating bar.

Generally, plate piece 9 is not used, and only multiple plate pieces (21*a*, 21*b*; 31*a*, 31*b*) having the same height are set to extend toward yarn (Z) from the upper and lower inner-wall surfaces (21, 31) of first and second seal chambers (2, 3). Here, not only extending from the upper and lower inner-wall surfaces (21, 31), multiple plate pieces (21*a*, 21*b*; 31*a*, 31*b*) may also be arranged in such a way that they extend at right angles toward yarn (Z) from the upper, lower, right and left portions of inner-wall surfaces (21, 31).

From yarn entrance (2*a*) of pressurized steam drawing apparatus 1, multiple continuous yarns (Z) are arranged horizontally to be introduced to first seal chamber 2, continuously run toward yarn exit (3*a*) of second seal chamber 3 through yarn running passage 14 with a cross-sectional slit shape formed between yarn entrance (10*a*) and yarn exit (10*b*) of steam chamber 10, and are sent out from yarn exit (3*a*) toward the subsequent processing step not shown in the accompanied illustrations. Yarn (Z) is drawn at a predetermined stretch ratio under high-temperature and high-pressure steam atmosphere in steam chamber 10 while running from yarn running passage 13 through passage 14.

Steam drawing apparatus 1 of the present invention is provided with first yarn-position regulating bar 8. When running yarn (Z) oscillates due to the steam current or the like, first yarn-position regulating bar 8 prevents running yarn (Z) from touching plate pieces (31*a*, 31*b*) in second seal chamber 3 by first bringing the yarn into contact with yarn-position regulating bar 8 before the yarn touches plate pieces (31*a*, 31*b*) in second seal chamber 3.

By so setting, while preventing problems such as broken single fibers of the yarn, formation of fuzz, entirely cut yarn and the like, the quality of the obtained yarn is prevented from being lowered.

First yarn-position regulating bar 8 is set horizontally in a direction intersecting the running direction of the yarn at right angles so as to prevent multiple yarns (Z) from touching plate pieces.

First yarn-position regulating bar 8 is arranged on the other side of yarn (Z) from steam introducing portion 4.

Since steam is introduced from steam introducing portion 4, running yarn (Z) tends to oscillate toward the other side of yarn (Z) from steam introducing portion 4, and often touches plate pieces (31*a*, 31*b*) closest to steam chamber 10 in second seal chamber 3. Therefore, first yarn-position regulating bar 8 needs to be arranged on the other side of yarn (Z) from steam introducing portion 4. A first yarn-position regulating bar may further be arranged on the same upper or lower side as steam inlet 11.

First yarn-position regulating bar 8 is located between steam introducing portion 4 and plate pieces (31*a*, 31*b*) positioned closest to steam chamber 10 on the same upper or lower side of yarn (Z) as first yarn-position regulating bar 8 among multiple pieces (31*a*, 31*b*) of second seal chamber 3. First yarn-position regulating bar 8 may be set inside steam chamber 10 or inside second seal chamber 3 as long as it is positioned upstream from the plate pieces closest to steam chamber 10 in second seal chamber 3.

Figure 3:
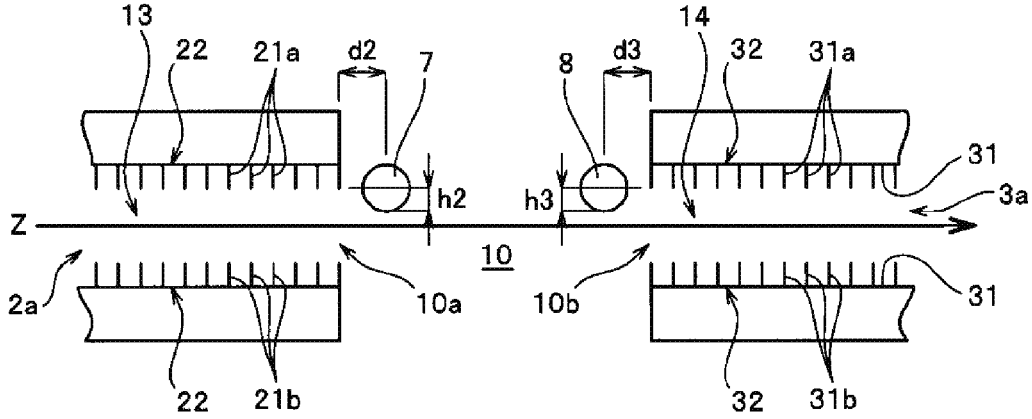
FIG. 3: a cross-sectional enlarged view schematically showing the steam chamber of the steam drawing apparatus shown in FIG. 1.
Figure 4:
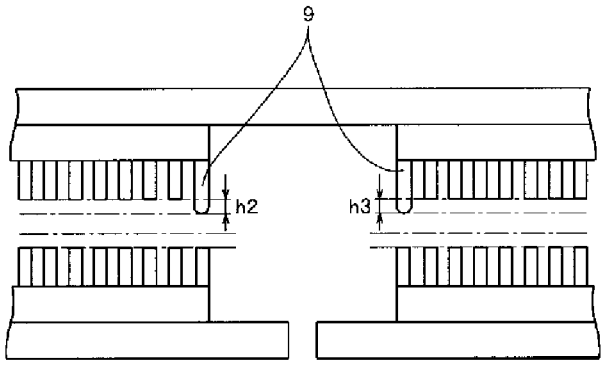
FIG. 4: a cross-sectional enlarged view schematically showing the steam chamber of the steam drawing apparatus shown in FIG. 2.

In addition, as shown in FIG. 3, distance (h3) is arranged so that the horizontal plane passing through the point of first yarn-position regulating bar 8 closest to yarn (Z) is set at least 0.1 mm closer to the yarn than the horizontal plane passing through the point closest to yarn (Z) located on the same upper or lower side of first yarn-position regulating bar 8 among multiple plate pieces (31*a*, 31*b*) of second seal chamber 3.

By so setting, yarn (Z) is prevented from touching plate pieces (31*a*, 31*b*) of labyrinth seal section 32 in second seal chamber 3. Accordingly, problems such as broken single fibers, formation of fuzz, entirely cut yarn and the like are prevented from occurring.

Distance (h3) above is preferred to be 0.2 mm or greater, more preferably 0.3 mm or greater, from the viewpoint of preventing yarn (Z) from touching plate piece (31*a*).

The upper limit value of distance (h3) is not limited specifically, but is preferred to be 0.5 mm or less from the viewpoint of sealing effects.

Regarding first yarn-position regulating bar 8, the portion of first yarn-position regulating bar 8 closer to yarn (Z) is preferred to be a rod or plate shape and to be rounded toward the running yarn.

The portion closer to yarn (Z) means where yarn (Z) touches first yarn-position regulating bar 8 when the yarn is oscillated. By processing such a portion to be rounded, problems such as broken single fibers, formation of fuzz, entirely cut yarn and the like are easier to prevent from occurring in yarn (Z).

When first yarn-position regulating bar 8 is set in steam chamber 10, the point of first yarn-position regulating bar 8 closest to yarn (Z) is preferred to be set at a distance no greater than one-quarter of the length of steam chamber 10 from the plane at the yarn exit in the yarn running direction.

Since steam introducing portion 4 is usually positioned in the center of steam chamber 10, by setting the aforementioned distance at no greater than one-quarter, the effect of the steam is suppressed, and it is easier to prevent the yarn from touching plate pieces (31*a*, 31*b*) of labyrinth seal section 32 in second seal chamber 3.

More specifically, the distance is preferred to be set 70 mm or less from the plane at the yarn exit of steam chamber 10 to the point of first yarn-position regulating bar 8 closest to the yarn (Z) so as to make it easier to prevent the yarn (Z) from touching plate pieces (31*a*, 31*b*) of labyrinth seal section 32 in second seal chamber 3. The distance is preferred to be 50 mm or less, more preferably 30 mm or less, from the viewpoint of preventing the aforementioned contact.

Figure 2:
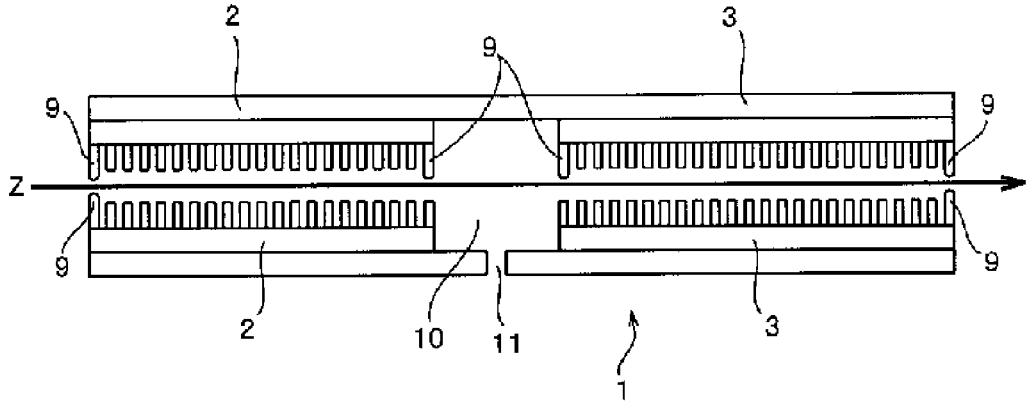
FIG. 2: a cross-sectional view of a steam drawing apparatus in which a rounded plate piece is provided in a labyrinth section to show an embodiment of the present invention.

As shown in FIG. 2, first yarn-position regulating bar 8 may be the plate pieces (31*a*, 31*b*) which are closest to steam chamber 10 among plate pieces (31*a*, 31*b*) of labyrinth portions 32, and whose portions closer to yarn (Z) are rounded toward the running yarn.

In such a case, first yarn-position regulating bar 8 is arranged in second seal chamber 3. The distance is preferred to be set at 70 mm or less, more preferably 30 mm or less, between the point of first yarn-position regulating bar 8 closest to the yarn and the side surface of a plate piece closest to first yarn-position regulating bar 8 in the labyrinth seal section.

By setting first yarn-position regulating bar 8 as described above, even when yarn (Z) is swayed by the steam introduced into the chamber, the yarn is prevented from touching the labyrinth seal having multiple plate pieces (31*a*, 31*b*) extending toward the yarn at right angles from the inner-wall surfaces of second seal chamber 3. Accordingly, problems such as broken single fibers, formation of fuzz, entirely cut yarn and the like are prevented, while the quality of the obtained yarn is prevented from decreasing.

Also, according to the present invention, in addition to first yarn-position regulating bar 8, second yarn-position regulating bar 7 is preferred to be positioned as follows: horizontally intersecting the running direction of yarn (Z) at right angles; on the other side of yarn (Z) from steam introducing portion 4; between steam introducing portion 4 and plate pieces (21*a*, 21*b*) located on the same upper or lower side of the yarn as second yarn-position regulating bar 7 and positioned closest to steam chamber 10 among multiple pieces (21*a*, 21*b*) of first seal chamber 2. The horizontal plane passing through the point of second yarn-position regulating bar 7 closest to yarn (Z) is preferred to be at least 0.1 mm closer to yarn (Z) than the horizontal plane passing through the point closest to yarn (Z) among multiple plate pieces (21*a*, 21*b*) of first seal chamber 2 located on the same upper or lower side of the yarn as second yarn-position regulating bar 7.

Second yarn-position regulating bar 7 is provided to prevent running yarn (Z) from touching plate pieces (21*a*, 21*b*) of the labyrinth seal section in first seal chamber 2. Second yarn-position regulating bar 7 is set symmetrical with first yarn-position regulating bar 8 seen from the central portion of steam chamber 10 in the yarn running direction. The positional relationship between second yarn-position regulating bar 7 and first seal chamber 2 is preferred to be set the same as that between first yarn-position regulating bar 8 and second seal chamber 3.

Also, the shape of second yarn-position regulating bar 7 is preferred to be the same as that of first yarn-position regulating bar 8.

Figure 5:
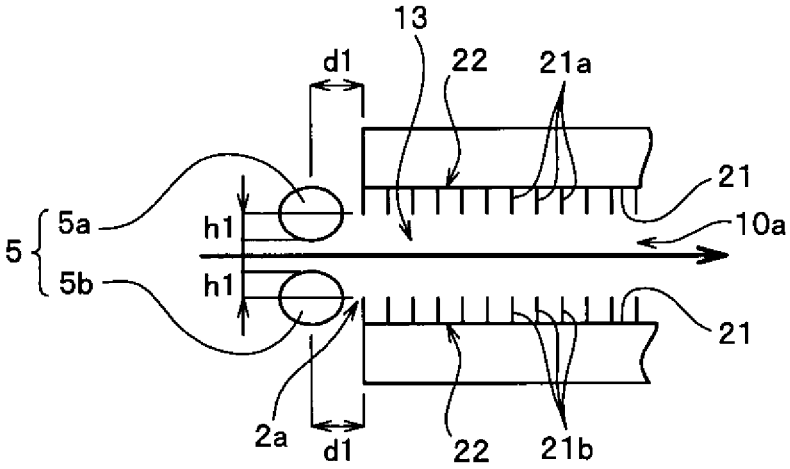
FIG. 5: a cross-sectional enlarged view schematically showing the yarn entry portion of the steam drawing apparatus shown in FIG. 1.
Figure 6:
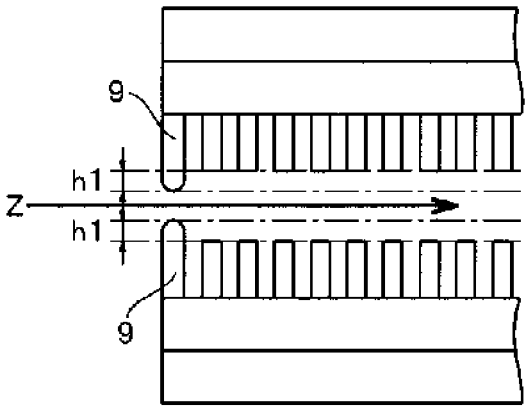
FIG. 6: a cross-sectional enlarged view schematically showing the yarn entry portion of the steam drawing apparatus shown in FIG. 2.
Figure 7:
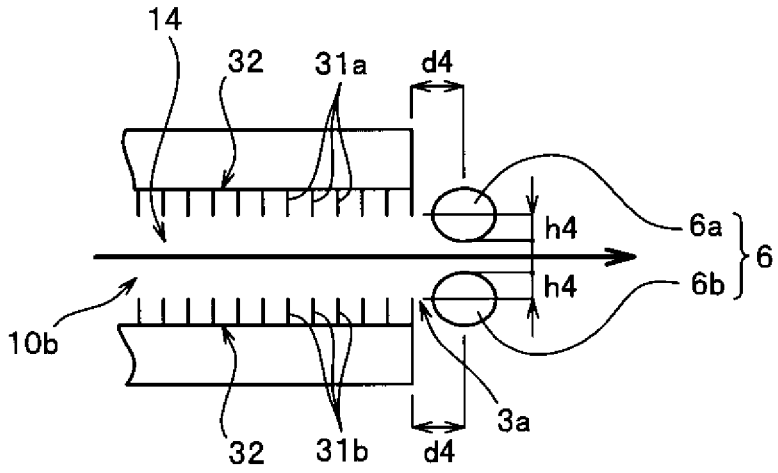
FIG. 7: a cross-sectional enlarged view schematically showing the yarn exit portion of the steam drawing apparatus shown in FIG. 1.
Figure 8:
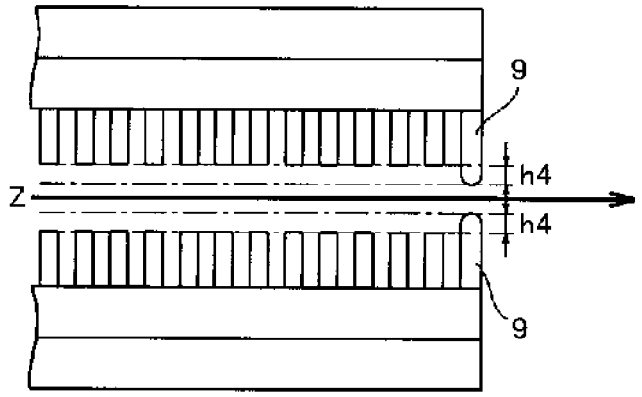
FIG. 8: a cross-sectional enlarged view schematically showing the yarn exit portion of the steam drawing apparatus shown in FIG. 2.

Moreover, as shown in FIGS. 5 and 7, at yarn entrance (2*a*) and yarn exit (3*a*) of first and second seal chambers (2, 3) respectively, a pair of third and fourth yarn-position regulating bars (5*a*, 5*b*; 6*a*, 6*b*) may be provided respectively on the upper and lower sides sandwiching running yarn (Z). By so setting, together with first and second yarn-position regulating bars (8, 7), yarn (Z) is prevented from touching upper and lower plate pieces (21*a*, 21*b*; 31*a*, 31*b*) of labyrinth sections (22, 32) in first and second seal chambers (2, 3) which extend at right angles toward yarn (Z) from the upper and lower inner-wall surfaces of first and second seal chambers (2, 3). Thus, problems such as broken single fibers, formation of fuzz and entirely cut yarn are prevented, and the quality of the obtained yarn is effectively prevented from lowering.

As shown in FIG. 5, third yarn-position regulating bar 5 is preferred to be positioned horizontally intersecting the running direction of yarn (Z) at right angles and located on the upper side and/or lower side of yarn (Z) to be adjacent upstream in the yarn running direction from plate pieces (21*a*, 21*b*) positioned closest to yarn entrance (2*a*) among plate pieces (21*a*, 21*b*) in first seal chamber 2. The horizontal plane passing through the point of third yarn-position regulating bar 5 closest to yarn (Z) is preferred to be at least 0.1 mm closer to the yarn than a horizontal plane passing through the point of plate pieces (21*a*, 21*b*) closest to yarn (Z) among the multiple plate pieces of first seal chamber 2 located on the same upper or lower side of yarn (Z) as third yarn-position regulating bar 5, and distance (d1) between yarn entrance (2*a*) and the point of third yarn-position regulating bar 5 closest to yarn (Z) is preferred to be set at 100 mm or less.

As shown in FIG. 7, fourth yarn-position regulating bar 6 is preferred to be positioned horizontally intersecting the running direction of yarn (Z) at right angles and located on the upper side and/or lower side of yarn (Z) to be adjacent downstream in the yarn running direction from plate pieces (31*a*, 31*b*) positioned closest to yarn exit (3*a*) among plate pieces (31*a*, 31*b*) in second seal chamber 3. The horizontal plane passing through the point of fourth yarn-position regulating bar 6 closest to yarn (Z) is preferred to be at least 0.1 mm closer to the yarn than a horizontal plane passing through the point of plate pieces (31*a*, 31*b*) closest to yarn (Z) among the multiple plate pieces of second seal chamber 3 located on the same upper or lower side of yarn (Z) as fourth yarn-position regulating bar 6, and distance (d4) between yarn exit (3*a*) and the point of fourth yarn-position regulating bar 6 closest to yarn (Z) is preferred to be set at 100 mm or less.

Third yarn-position regulating bar 5 and fourth yarn-position regulating bar 6 may be set on the upper or lower side of yarn (Z) or on both sides. Since third yarn-position regulating bar 5 and fourth yarn-position regulating bar 6 are away from steam inlet 11 and thus are hardly affected by the steam, they do not need to be set on the other side of yarn (Z) from steam inlet 11.

Distance (d1) is preferred to be set 100 mm or less between the point of third yarn-position regulating bar 5 closest to yarn (Z) and yarn entrance (2*a*) of first seal chamber 2.

When distance (d1) is 100 mm or less, it is easy to prevent yarn (Z) from touching plate pieces (21*a*, 21*b*) of labyrinth seal section 22 in first seal chamber 2. Thus, problems such as broken single fibers, formation of fuzz and entirely cut yarn are prevented, and the quality of the obtained yarn is effectively prevented from lowering.

Distance (d1) is more preferably set at 70 mm or less, even more preferably at 30 mm or less, from the viewpoint of preventing such contact.

Other positions and the shape of third yarn-position regulating bar 5 are set to be the same as those of second yarn-position regulating bar 7.

Also, as shown in FIG. 7, distance (d4) is preferred to be set at 100 mm or less between the point of fourth yarn-position regulating bar 6 closest to yarn (Z) and yarn exit (3*a*) of second seal chamber 3.

When distance (d4) is 100 mm or less, it is easy to prevent yarn (Z) from touching plate pieces (31*a*, 31*b*) of labyrinth seal section 32 in second seal chamber 3. Thus, problems such as broken single fibers, formation of fuzz and entirely cut yarn are prevented, and the quality of the obtained yarn is effectively prevented from lowering.

Distance (d4) is more preferably set at 70 mm or less, even more preferably at 30 mm or less, from the viewpoint of preventing contact.

Other positions and the shape of fourth yarn-position regulating bar 6 is set to be the same as those of first yarn-position regulating bar 8.

Yarn-position regulating bars 5~8 may each be shaped as a fixed bar having a circular cross section, a free rotating roll, or a plate with a portion closer to the yarn to be rounded as shown in FIGS. 1~8; or a plate piece 9 arranged at the end near the yarn entrance or exit of labyrinth seal sections (22, 32) and set taller than other plate pieces (21*a*, 21*b*; 31*a*, 31*b*) as shown in FIGS. 2, 4, 6 and 8. The tip portion of plate piece 9 near yarn (Z) is rounded.

When plate pieces 9 are arranged in first and second seal chambers (2, 3), portions of plate pieces 9 near the yarn in labyrinth seal sections (22, 32) are preferred to be rounded from the viewpoint of the ease of positioning and sealing the steam. When plate pieces 9 are arranged in other positions, a fixed bar having a circular cross section is preferable from the viewpoints of the ease of positioning and preventing problems such as fibers wrapping around the bar.

The surface roughness (Ra) of each of position regulating bars 5~8 is preferred to have a value of 0.4 a or smaller.

When surface roughness (Ra) is 0.4 a or smaller, if yarn (Z) touches any of position regulating bars 5~8, damage to yarn (Z) is minimal, and problems such as broken single fibers, formation of fuzz, entirely cut yarn and the like are unlikely to occur.

Moreover, yarn-position regulating bars are each preferred to be a non-rotating fixed bar to prevent single fibers of yarn (Z) from wrapping around the bar. However, it is necessary to smooth the surface of a fixed bar so as to minimize the friction. Alternatively, yarn-position regulating bars may each be formed to be a free rotating roll.

Steam chamber 10 may be either a tube type or a box type. The present invention is applicable to any of a tube type suitable for single-spindle drawing or a box type suitable for multi-spindle drawing.

Yarn-position regulating bars 5~9 are each preferred to be made of ceramic-coated stainless steel. To suppress abrasion of yarn (Z) caused by friction with a yarn-position regulating bar, the surface of a bar is preferred to be smoothed to minimize its surface roughness. Thus, yarn-position regulating bars 5~9 are each preferred to be made of ceramic-coated stainless steel as described above. However, it is also an option to use titanium, or hard chromium-plated iron or stainless steel.

The aforementioned first and second yarn-position regulating bars (8, 7) as well as third and fourth yarn-position regulating bars (5, 6) are preferred to be rounded to suppress damage to the yarn. Rounded surfaces are also preferred to be formed on plate pieces (21*a*, 21*b*; 31*a*, 31*b*) of labyrinth seal sections (22, 32) in first and second seal chambers (2, 3).

In pressurized steam drawing apparatus 1 according to the present invention, first seal chamber 2 and second seal chamber 3 are provided before and after steam chamber 10 in the yarn running direction to draw running yarn (Z) by pressurized steam. As an embodiment suitable for first and second seal chambers (2, 3), their seal structures are preferred to be formed with labyrinth seal. Such labyrinth seal is made up of labyrinth seal sections (22, 32) having multiple plate pieces (21*a*, 31*a*) that extend at right angles toward the yarn from inner-wall surfaces (21, 31) of seal chambers (2, 3) respectively. Here, it is important for yarn (Z) not to touch rounded plate pieces (21*a*, 31*a*) from yarn entrance (2*a*) of first seal chamber 2 through yarn exit (3*a*) of second seal chamber 3. By preventing such contact, problems such as broken single fibers, formation of fuzz and entirely cut yarn are unlikely to occur, and lowered quality of the obtained yarn (Z) is prevented.

When rounded plate piece 9 located at the portion of second seal chamber 3 closest to the exit of labyrinth section 32 in second seal chamber 3 is set as a fourth yarn-position regulating bar, the distance is preferred to be 70 mm or less between the point of the fourth yarn-position regulating bar closest to the yarn and the side surface of adjacent plate piece (31*a*). In addition, the distance is preferred to be 70 mm or less between the center of rounded plate piece 9 set as a third yarn-position regulating bar located at the point of labyrinth seal section 22 closest to the yarn entrance in first seal chamber 2 and a side surface of adjacent plate piece (21*a*). By setting those distances at 70 mm or less, the results of preventing yarn (Z) from touching labyrinth seal sections (22, 32) are excellent, problems such as single broken fibers, formation of fuzz and entirely cut yarn decrease, and lowered quality of the obtained yarn (Z) is prevented.

When a rounded plate piece of labyrinth seal section 32 closest to yarn exit (3*a*) of second seal chamber 3 is set as a fourth yarn-position regulating bar, distance (h4) is set closer to the yarn in a range of no less than 0.1 mm but no greater than 0.5 mm between a horizontal plane passing through the point of the fourth yarn-position regulating bar closest to yarn (Z) and a horizontal plane passing through the point closest to yarn (Z) among plate pieces (31*a*) of second seal chamber 3.

When a rounded plate piece of labyrinth seal section 22 closest to yarn entrance (2*a*) of first seal chamber 2 is set as a third yarn-position regulating bar, distance (h1) is set closer to the yarn in a range of no less than 0.1 mm but no greater than 0.5 mm between a horizontal plane passing through the point of the third yarn-position regulating bar closest to yarn (Z) and a horizontal plane passing through the point closest to yarn (Z) among plate pieces (21*a*) of the first seal chamber. By setting those distances to be no less than 0.1 mm but no greater than 0.5 mm, yarn (Z) is prevented from touching plate pieces (21*a*, 31*a*) of labyrinth seal sections (22, 32), while the occurrence of touching first and second yarn-position regulating bars (8, 7) is minimized. Accordingly, problems such as broken single fibers, formation of fuzz and entirely cut yarn are prevented.

When yarn, especially acrylonitrile-based yarn as a carbon-fiber precursor, is drawn using a pressurized steam drawing apparatus structured as above, problems such as broken single fibers, formation of fuzz and entirely cut yarn are prevented, and the obtained carbon-fiber precursor yarn forms hardly any fuzz. Thus, after baking, a high-quality carbon fiber with excellent properties is obtained.

EXAMPLES

In the following, the present invention is described in detail by referring to examples.

An evaluation of fuzz formation of the drawn yarn in the examples was conducted after steam drawing by visually observing the running yarn for three minutes and by counting the number of fuzz formations on the yarn surface.

Example 1

Acrylonitrile copolymer made of 98% acrylonitrile and 2% methacrylic acid was dissolved in dimethylformamide to prepare a spinning stock solution with a polymer concentration of 23%. The spinning stock solution was discharged in a 10° C. coagulation bath with an 80% concentration using a spinning nozzle to obtain coagulated fibers. The coagulated fibers were subjected to washing, cool drawing and hot-water drawing, followed by oil treatment and dry-densification. Accordingly, an acrylic yarn was obtained.

The obtained acrylic yarn was drawn using a steam drawing apparatus which is provided with a 500-mm-long steam chamber in the yarn running direction into which pressurized steam is introduced along with first and second seal chambers arranged adjacent respectively to the yarn entrance and exit of the steam chamber. Such a steam drawing apparatus is structured as follows:

labyrinth seal is used for seal chambers having multiple plate pieces that extend at right angles toward the yarn from the upper and lower inner-wall surfaces of the seal chambers respectively; first and second titanium yarn-position regulating bars, which are rounded with a surface roughness (Ra) of 0.4 a, are set on the inner side of the yarn entrance and exit of the steam chamber to have a predetermined distance away from the yarn and to be on the other side of the yarn from the steam inlet; and a pair of third and fourth yarn-position regulating bars are further arranged respectively outside the first and second seal chambers to be located on the upper and lower sides of the yarn of a predetermined distance from the yarn.

The following distances were all set at 10 mm: the shortest distance (d3) between the plane at the yarn exit of the steam chamber and the point of the first yarn-position regulating bar closest to the yarn; the shortest distance (d2) between the plane at the yarn entrance of the steam chamber and the point of the second yarn-position regulating bar closest to the yarn; the shortest distance (d1) between the point of the third yarn-position regulating bar closest to the yarn and the plane at the yarn entrance of the first seal chamber; and the shortest distance (d4) between the plane at the yarn exit of the second seal chamber and the point of the fourth yarn-position regulating bar closest to the yarn.

The yarn-position regulating bars were each arranged to have the following distances at 0.3 mm: the shortest distance (h3) between a horizontal plane passing through the point of the first yarn-position regulating bar closest to the yarn and a horizontal plane passing through the point closest to the yarn located on the same upper or lower side of the yarn as the first yarn-position regulating bar among multiple plate pieces in the second seal chamber; the shortest distance (h2) between a horizontal plane passing through the point of the second yarn-position regulating bar closest to the yarn and a horizontal plane passing through the point closest to the yarn located on the same upper or lower side of the yarn as the first yarn-position regulating bar among multiple plate pieces in the second seal chamber; and the shortest distance (h1) between a horizontal plane passing through the point of the third yarn-position regulating bar closest to the yarn and a horizontal plane passing through the point closest to the yarn located on the same upper or lower side of the yarn as the third yarn-position regulating bar among multiple plate pieces in the first seal chamber; and the shortest distance (h4) between a horizontal plane passing through the point of the fourth yarn-position regulating bar closest to the yarn and a horizontal plane passing through the point closest to the yarn located on the same upper or lower side of the yarn as the first yarn-position regulating bar among multiple plate pieces in the second seal chamber.

The yarn was drawn to four times as long by setting the interval between plate pieces of the upper and lower labyrinth seal sections in the first and second seal chambers at 1.6 mm, and the steam pressure in the steam drawing apparatus at 0.4 MPa. Then, the yarn was dried and carbon-fiber precursor yarn was obtained having a single-fiber fineness of 0.7 dTex and the number of single fibers at 12000.

The formation of fuzz of the precursor yarn was evaluated and the results are shown in Table 1.

TABLE 1

| | position of yarn-position regulating bar | | | | | | | | | | | | | | |
|---|---|---|---|---|---|---|---|---|---|---|---|---|---|---|---|
| | adjacent to 1st seal chamber entrance | adjacent to yarn entrance in steam chamber | adjacent to yarn exit in steam chamber | adjacent to 2nd seal chamber exit | d1 mm | d2 mm | d3 mm | d4 mm | h1 mm | h2 mm | h3 mm | h4 mm | material | surface roughness (Ra) | fuzz number |
| example 1 | yes | yes | yes | yes | 10 | 10 | 10 | 10 | 0.3 | 0.3 | 0.3 | 0.3 | titanium | 0.4a | 0 |
| example 2 | yes | yes | yes | yes | 10 | 30 | 30 | 10 | 0.3 | 0.3 | 0.3 | 0.3 | titanium | 0.4a | 0 |
| example 3 | yes | yes | yes | yes | 10 | 60 | 60 | 10 | 0.3 | 0.3 | 0.3 | 0.3 | titanium | 0.4a | 1 |
| example 4 | yes | yes | yes | yes | 50 | 10 | 10 | 50 | 0.3 | 0.3 | 0.3 | 0.3 | titanium | 0.4a | 1 |
| example 5 | yes | yes | yes | yes | 90 | 10 | 10 | 90 | 0.3 | 0.3 | 0.3 | 0.3 | titanium | 0.4a | 3 |
| example 6 | yes | yes | yes | yes | 10 | 10 | 10 | 10 | 0.3 | 0.5 | 0.5 | 0.3 | titanium | 0.4a | 0 |
| example 7 | yes | yes | yes | yes | 10 | 10 | 10 | 10 | 0.3 | 0.1 | 0.1 | 0.3 | titanium | 0.4a | 1 |
| example 8 | yes | yes | yes | yes | 10 | 10 | 10 | 10 | 0.5 | 0.3 | 0.3 | 0.5 | titanium | 0.4a | 0 |
| example 9 | yes | yes | yes | yes | 10 | 10 | 10 | 10 | 0.1 | 0.3 | 0.3 | 0.1 | titanium | 0.4a | 0 |
| example 10 | yes | yes | yes | yes | 10 | 10 | 10 | 10 | 0 | 0.3 | 0.3 | 0 | titanium | 0.4a | 3 |
| example 11 | yes | yes | yes | yes | 10 | 10 | 10 | 10 | 0.1 | 0.1 | 0.1 | 0.1 | titanium | 0.4a | 1 |
| example 12 | yes | yes | yes | yes | 10 | 10 | 10 | 10 | 0.5 | 0.5 | 0.5 | 0.5 | titanium | 0.4a | 0 |
| example 13 | no | yes | yes | no | — | 10 | 10 | — | — | 0.3 | 0.3 | — | titanium | 0.4a | 3 |
| example 14 | no | no | yes | no | — | — | 10 | — | — | — | 0.3 | — | titanium | 0.4a | 2 |

TABLE 1-continued

| | position of yarn-position regulating bar | | | | | | | | | | | | | | |
|---|---|---|---|---|---|---|---|---|---|---|---|---|---|---|---|
| | adjacent to 1st seal chamber entrance | adjacent to yarn entrance in steam chamber | adjacent to yarn exit in steam chamber | adjacent to 2nd seal chamber exit | d1 mm | d2 mm | d3 mm | d4 mm | h1 mm | h2 mm | h3 mm | h4 mm | material | surface rough-ness (Ra) | fuzz number |
| example 15 | yes (rounded plate piece *1) | yes | yes | yes (rounded plate piece *2) | — | 10 | 10 | — | 0.3 | 0.3 | 0.3 | 0.3 | titanium | 0.4a | 2 |
| example 16 | no | no | yes (rounded plate piece *3) | no | — | — | — | — | — | — | 0.3 | — | titanium | 0.4a | 2 |
| comp. example 1 | no | no | no | no | — | — | — | — | — | — | — | — | — | — | 21 |
| comp. example 2 | yes | no | no | yes | 10 | — | — | 10 | 0.3 | — | — | 0.3 | titanium | 0.4a | 15 |
| comp. example 3 | no | yes | no | no | — | 10 | — | — | — | 0.3 | — | — | titanium | 0.4a | 9 |
| comp. example 4 | yes | yes | yes | yes | 10 | 10 | 10 | 10 | 0.3 | 0 | 0 | 0.3 | titanium | 0.4a | 16 |

*1 rounded plate piece: rounded plate piece positioned on the most upstream side of the first seal chamber entrance.
*2 rounded plate piece: rounded plate piece positioned on the most downstream side of the second seal chamber exit.
*3 rounded plate piece: rounded plate piece positioned on the most upstream side of the second seal chamber entrance.

Examples 2~14

Carbon-fiber precursor yarns were each obtained the same as in Example 1 except that the positions of yarn-position regulating bars were changed as shown in Table 1. The fuzz formations on the obtained precursor yarn were each evaluated and the results are shown in Table 1.

Example 15

Carbon-fiber precursor yarn was obtained the same as in Example 1 except that the plate piece closest to the yarn entrance among plate pieces of the first seal chamber was rounded and set as a third yarn-position regulating bar, the plate piece closest to the yarn exit among plate pieces in the second seal chamber was rounded and set as a fourth yarn-position regulating bar, and each setting was changed as shown in Table 1. The formation of fuzz on the obtained precursor yarn was evaluated and the result is shown in Table 1.

The third yarn-position regulating bar is arranged in the first seal chamber and the fourth yarn-position regulating bar is arranged in the second seal chamber.

Example 16

Carbon-fiber precursor yarn was obtained the same as in Example 1 except that the plate piece closest to the steam chamber among plate pieces in the second seal chamber was rounded and set as a first yarn-position regulating bar and the setting was changed as shown in Table 1. The fuzz formation on the obtained precursor yarn was evaluated and the result is shown in Table 1.

The first yarn-position regulating bar is arranged in the second seal chamber.

Comparative Example 1

Carbon-fiber precursor yarn was obtained the same as in Example 1 except that yarn-position regulating bars were not used. The fuzz formation on the obtained precursor yarn was evaluated and the result is shown in Table 1.

Comparative Examples 2~4

Carbon-fiber precursor yarns were each obtained the same as in Example 1 except that the positions of yarn-position regulating bars were changed as shown in Table 1. The fuzz formations on the obtained precursor yarns were each evaluated and the results are shown in Table 1.

As found in Table 1, except for Examples 13 and 14 of the present invention, a yarn-position regulating bar is provided in each predetermined position near the yarn entry portion and exit portion of the first and second seal chambers and in the steam chamber. Thus, the yarn continuously running in the pressurized steam drawing apparatus in one direction does not touch multiple plate pieces of labyrinth sections in the first and second seal chambers arranged before and after the steam chamber in which pressurized steam is gushing out, and thus smooth continuous running is achieved. Accordingly, hardly any cut yarn or fuzz formation is observed during drawing, and consistent production is achieved.

Although neither the third nor the fourth yarn-position regulating bar is provided on the entry side or exit side of the apparatus in Example 13, second and first yarn-position regulating bars are arranged on the entry side and exit side of the steam chamber. Accordingly, the number of fuzz formations is not so different from that in the other examples.

Moreover, neither the third nor the fourth yarn-position regulating bar is provided on the entry side or exit side of the apparatus in Example 14, and a second yarn-position regulating bar is not provided on the entry side of the steam chamber, but a first yarn-position regulating bar is arranged on the exit side of the steam chamber. Accordingly, the number of fuzz formations is not so different from that in the other examples.

From the results above, by providing at least a first yarn-position regulating bar on the exit side of the steam chamber, it is found that fuzz formations on the yarn are easier to prevent.

Regarding Examples 15 and 16, when the plate piece closest to the edge among multiple plate pieces of the labyrinth seal section in a seal chamber is rounded and set as a yarn-position regulating bar, it is found to be effective in preventing formation of fuzz.

On the other hand, regarding comparative examples, especially as found in Comparative Examples 1 and 2, when no yarn regulation guide is provided in the steam chamber, a significantly greater number of fuzz formations was observed. Also, as found in Comparative Example 4, when yarn-position regulating bars are set at the same height as plate pieces, a significantly greater number of fuzz formations was observed.

When a yarn-position regulating bar was provided only on the entry side of the steam chamber, as shown in Comparative Example 3, a greater number of fuzz formations was observed than in Example 14 with a yarn-position regulating bar provided only on the exit side of the steam chamber.

DESCRIPTION OF NUMERICAL REFERENCES

1 pressurized steam drawing apparatus
10 steam chamber
10*a* yarn entrance (of steam chamber)
10*b* yarn exit (of steam chamber)
11 steam inlet
12 steam pipe
13 yarn running passage (in first seal chamber)
14 yarn running passage (in second seal chamber)
2 first seal chamber
2*a* yarn entrance
21 inner-wall surface
21*a*, 21*b* (upper, lower) plate piece
22 labyrinth seal section
3 second seal chamber
3*a* yarn exit
31 inner-wall surface
31*a*, 31*b* (upper, lower) plate piece
32 labyrinth seal section
4 steam introducing portion
5 third yarn-position regulating bar
5*a*, 5*b* (upper, lower) third yarn-position regulating bar
6 fourth yarn-position regulating bar
6*a*, 6*b* (upper, lower) fourth yarn-position regulating bar
7 second yarn-position regulating bar (in steam chamber)
8 first yarn-position regulating bar (in steam chamber)
9 rounded plate piece of labyrinth seal section (yarn-position regulating bar)
Z yarn

What is claimed is:

1. A steam drawing apparatus for providing pressurized steam on running yarn to draw the yarn, comprising:

a steam chamber into which pressurized steam is introduced;

a first seal chamber adjacent to a yarn entrance of the steam chamber; and a second seal chamber adjacent to a yarn exit of the steam chamber, wherein the steam chamber has a steam introducing portion to introduce the steam, the first seal chamber and the second seal chamber are each provided with a labyrinth seal section having a plurality of plate pieces extending respectively from an upper inner wall surface and a lower inner wall surface toward the yarn, a first yarn-position regulating bar is provided to prevent the running yarn from touching the plate pieces, the first yarn-position regulating bar extends horizontally intersecting the running direction of the yarn at right angles, and is located on an other side of the yarn from the steam introducing portion, while being positioned between the steam introducing portion and a plate piece of the second seal chamber located on a same upper side of the yarn and/or a same lower side of the yarn as the first yarn-position regulating bar and positioned closest to the steam chamber, and a horizontal plane passing through a point of the first yarn-position regulating bar closest to the yarn is set at least 0.1 mm closer to the yarn than a horizontal plane passing through a tip of the plate piece closest to the yarn among the plurality of the plate pieces of the second seal chamber on the same upper or lower side of the yarn as the first yarn-position regulating bar.

2. The steam drawing apparatus according to claim 1, wherein the first yarn-position regulating bar is shaped as a rod or a plate, and the portion closest to the yarn is rounded toward the running yarn.

3. The steam drawing apparatus according to claim 1, wherein the first yarn-position regulating bar is arranged so that the distance between the point of the first yarn-position regulating bar closest to the yarn in the steam chamber and a plane at the yarn exit of the steam chamber is set to be no greater than one-quarter of the length of the steam chamber in the yarn running direction, and the plane is a vertical plane horizontally intersecting a running direction of the yarn.

4. The steam drawing apparatus according to claim 1, wherein the portion of the plate piece closest to the yarn is rounded toward the running yarn.

5. The steam drawing apparatus according to claim 1, further comprising a second yarn-position regulating bar to prevent the running yarn from touching the plate pieces, wherein the second yarn-position regulating bar extends horizontally intersecting the running direction of the yarn at right angles, and is located on the other side of the yarn from the steam introducing portion while being positioned between the steam introducing portion and a plate piece of the first seal chamber located on the same upper or lower side of the yarn as the second yarn-position regulating bar and positioned closest to the steam chamber, and a horizontal plane passing through a point of the second yarn-position regulating bar closest to the yarn is set at least 0.1 mm closer to the yarn than a horizontal plane passing through a tip of the plate piece closest to the yarn among the plurality of the plate pieces of the first seal chamber located on the same upper or lower side of the yarn as the second yarn-position regulating bar.

6. The steam drawing apparatus according to claim 5, wherein the second yarn-position regulating bar is shaped as a rod or a plate, and the portion closest to the yarn is rounded toward the running yarn.

7. The steam drawing apparatus according to claim 5, wherein the second yarn-position regulating bar is arranged so that the distance between the point of the second yarn-position regulating bar closest to the yarn in the steam chamber and a plane at the yarn exit of the steam chamber is set to be no greater than one-quarter of the length of the steam chamber in the yarn running direction,. and the plane is a vertical plane horizontally intersecting a running direction of the yarn.

8. The steam drawing apparatus according to claim 5, wherein the portion of the plate piece closest to the yarn is rounded toward the running yarn.

9. The steam drawing apparatus according to claim 5 wherein a third yarn-position regulating bar is positioned horizontally intersecting the running direction of the yarn at right angles and is located on the upper side and/or lower side of the yarn to be adjacent upstream in the yarn running direction to a plate piece closest to the yarn entrance of the apparatus among plate pieces in the first seal chamber, and the horizontal plane passing through a point of the third yarn-position regulating bar closest to the yarn is set at least 0.1 mm closer to the yarn than a horizontal plane passing through the point of the plate piece closest to the yarn among the plurality of plate pieces of the first seal chamber located on the same upper or lower side of the yarn as the third yarn-position regulating bar, and the distance between the entrance to the first seal chamber and the point of the third yarn-position regulating bar closest to the yarn is set at 100 mm or less;

and a fourth yarn-position regulating bar is positioned horizontally intersecting the running direction of the yarn at right angles and is located on the upper side and/or lower side of the yarn to be adjacent downstream in the yarn running direction to the plate piece closest to the yarn exit of the apparatus among plate pieces in the second seal chamber, and the horizontal plane passing through a point of the fourth yarn-position regulating bar closest to the yarn is set at least 0.1 mm closer to the yarn than a horizontal plane passing through the point of the plate piece closest to the yarn among the plurality of plate pieces of the second seal chamber located on the same upper or lower side of the yarn as the fourth yarn-position regulating bar, and the distance between the exit of the second seal chamber and the point of the fourth yarn-position regulating bar closest to the yarn is set at 100 mm or less.

10. The steam drawing apparatus according to claim 9, wherein the third yarn-position regulating bar and/or the fourth yarn-position regulating bar is shaped as a rod or a plate, and the portion closest to the yarn is rounded toward the running yarn.

11. The steam drawing apparatus according to claim 9, wherein the portion of the plate piece closest to the yarn is rounded toward the running yarn.

12. The steam drawing apparatus according to claim 5, wherein each of the yarn-position regulating bars is a non-rotating bar.

13. The steam drawing apparatus according to claim 5, wherein surface roughness (Ra) of each of the yarn-position regulating bars is set at 0.4a or less.

14. The steam drawing apparatus according to claim 1, wherein the steam chamber is a tube-shaped steam chamber.

15. The steam drawing apparatus according to claim 1, wherein the steam chamber is a box-shaped steam chamber.

16. The steam drawing apparatus according to claim 5, wherein each of the yarn-position regulating bars is made of ceramic-coated stainless steel.

17. The steam drawing apparatus according to claim 5, wherein each of the yarn-position regulating bars is made of titanium or hard chromium-plated iron or stainless steel.

* * * * *